US008747027B1

(12) United States Patent
Singleton

(10) Patent No.: US 8,747,027 B1
(45) Date of Patent: Jun. 10, 2014

(54) REINFORCED SILT RETENTION SHEET

(71) Applicant: Silt-Saver, Inc., Conyers, GA (US)

(72) Inventor: Earl R. Singleton, Oxford, GA (US)

(73) Assignee: Silt-Saver, Inc., Conyers, GA (US)

( * ) Notice: Subject to any disclaimer, the term of this patent is extended or adjusted under 35 U.S.C. 154(b) by 0 days.

(21) Appl. No.: 13/690,684

(22) Filed: Nov. 30, 2012

(51) Int. Cl.
*E02D 17/20* (2006.01)

(52) U.S. Cl.
USPC ..... 405/302.7; 405/302.6

(58) Field of Classification Search
USPC ..... 405/302.7, 302.6, 302.4, 32, 33, 34, 35, 405/21, 15, 16
See application file for complete search history.

(56) References Cited

U.S. PATENT DOCUMENTS

| | | | |
|---|---|---|---|
| 1,964,419 | A | 6/1934 | Asten |
| 2,201,279 | A | 5/1940 | Willing |
| 2,375,345 | A | 5/1945 | Burhans |
| 2,889,932 | A | 6/1959 | Mackintosh |
| 3,252,484 | A | 5/1966 | Meyer et al. |
| 3,283,788 | A | 11/1966 | Bottomley et al. |
| 3,699,686 | A | 10/1972 | De Winter |
| 3,889,851 | A | 6/1975 | Kain |
| 4,034,428 | A | 7/1977 | Jacuzzi |
| 4,279,535 | A | 7/1981 | Gagliardi et al. |
| 4,302,495 | A | 11/1981 | Marra |
| 4,418,432 | A | 12/1983 | Vidal |
| 4,419,232 | A | 12/1983 | Arntyr et al. |
| 4,525,273 | A | 6/1985 | Logsdon |
| 4,606,964 | A | 8/1986 | Widerman |
| 4,734,311 | A | 3/1988 | Sokolowski |
| 4,756,511 | A | 7/1988 | Wright, III |
| 4,925,342 | A | 5/1990 | Hendy |
| 5,108,224 | A | 4/1992 | Cabaniss et al. |
| 5,201,497 | A | 4/1993 | Williams et al. |
| 5,297,895 | A | 3/1994 | Johnson |
| 5,348,419 | A | 9/1994 | Bailey et al. |
| 5,380,582 | A | 1/1995 | Neely et al. |
| 5,389,166 | A | 2/1995 | White |
| 5,407,570 | A | 4/1995 | Hobson, Jr. |
| 5,431,991 | A | 7/1995 | Quantrille et al. |
| 5,585,161 | A | 12/1996 | DiFloe et al. |
| 5,587,072 | A | 12/1996 | Regan |
| 5,643,445 | A | 7/1997 | Billias et al. |
| 5,735,640 | A | 4/1998 | Meyer et al. |
| 5,758,868 | A | 6/1998 | Shea |
| 5,776,567 | A | 7/1998 | Schilling et al. |
| 5,843,306 | A | 12/1998 | Singleton |
| 5,877,096 | A | 3/1999 | Stevenson et al. |
| 5,928,752 | A | 7/1999 | Newquist |
| 5,954,451 | A | 9/1999 | Presby |
| 5,954,952 | A | 9/1999 | Strawser, Sr. |
| 6,004,457 | A | 12/1999 | Singleton |

(Continued)

*Primary Examiner* — Frederick L Lagman
(74) *Attorney, Agent, or Firm* — Womble Carlyle Sandridge & Rice, LLP

(57) ABSTRACT

A reinforced silt retention material with a variable sieve capability is provided for use in soil erosion control applications. The reinforced silt retention material includes a sheet of water permeable filtering material having varying apparent opening sizes at a series of filtering zones defined along the sheet, which allows varying amounts of runoff water to pass through the sheet but resists the passage of silt and debris therethrough. The silt retention material further includes one or more reinforcing elements that provide additional support to the sheet to protect against tearing and/or undue movement of the sheet, as well as provide attachment points for fasteners used to fasten the sheet to support members for proper positioning during erosion control applications.

26 Claims, 5 Drawing Sheets

(56) References Cited

U.S. PATENT DOCUMENTS

| | | | | |
|---|---|---|---|---|
| 6,093,663 | A | 7/2000 | Ouellette et al. | |
| 6,169,045 | B1 | 1/2001 | Pike et al. | |
| 6,261,445 | B1 | 7/2001 | Singleton | |
| 6,334,953 | B1 | 1/2002 | Singleton | |
| 6,416,674 | B1 | 7/2002 | Singleton et al. | |
| 6,428,693 | B2 | 8/2002 | Singleton | |
| 6,503,856 | B1 | 1/2003 | Broadway et al. | |
| 6,558,075 | B2 * | 5/2003 | Benedict et al. | 405/302.7 |
| 6,616,383 | B2 | 9/2003 | Janz | |
| 6,649,547 | B1 | 11/2003 | Arnold et al. | |
| 6,709,579 | B1 | 3/2004 | Singleton et al. | |
| 6,722,817 | B2 | 4/2004 | Benedict et al. | |
| 6,723,669 | B1 | 4/2004 | Clark et al. | |
| 7,074,326 | B2 | 7/2006 | Singleton | |
| 7,157,010 | B1 | 1/2007 | Wolfe | |
| 7,465,129 | B2 | 12/2008 | Singleton | |
| 7,534,355 | B2 | 5/2009 | Lockerman et al. | |
| RE42,695 | E | 9/2011 | Singleton | |
| 8,277,646 | B2 | 10/2012 | Singleton | |
| 8,465,231 | B2 * | 6/2013 | Christopher | 405/302.7 |
| 2003/0159342 | A1 | 8/2003 | Ruiz et al. | |
| 2006/0133897 | A1 | 6/2006 | Allard et al. | |
| 2006/0133900 | A1 * | 6/2006 | Singleton | 405/302.7 |
| 2008/0112766 | A1 * | 5/2008 | Kerman | 405/302.7 |
| 2009/0173699 | A1 * | 7/2009 | Wacome | 210/747 |
| 2010/0248574 | A1 | 9/2010 | King et al. | |
| 2011/0305530 | A1 | 12/2011 | Hunt | |

* cited by examiner

REINFORCED SILT RETENTION SHEET

TECHNICAL FIELD

The present invention is directed to materials used in water runoff management and erosion control and, more specifically, to water runoff filtering sheet materials for sediment control and silt retention.

BACKGROUND OF THE INVENTION

Sediment has been recognized as one of the most significant water quality impairments in the United States. Historically, soil erosion was primarily considered an agricultural issue, but more recently, construction sites have received increased attention as more land is being developed and there is greater awareness of water quality issues. Silt fences and erosion barriers traditionally have become commonly used for erosion and sediment control applications being used in the field to reduce soil loss from construction, residential and agricultural sites. Most silt fences generally are constructed of woven geotextile fabrics, typically supported by posts or stakes driven into the ground. Such silt fences are designed to help retard storm water runoff and to filter silt, sediment and debris from the fluid as it flows away from a development site. Often, as larger particles block the pores in the silt fence, sediment or debris is collected and builds up against the fence, which can cause the storm water runoff to pool or "pond" behind the fence, promoting sedimentation.

However, as storm water runoff collects against the silt fencing material, the silt fencing accordingly is subjected to increasing hydrostatic pressures, and as the water rises, this pressure builds against the fencing, often causing a blowout and/or collapse of the fencing. As a result, sediment, debris and other unwanted materials will be released, which can cause environmental issues and require extensive and costly clean-up operations. This can be especially problematic during times of heavy rains and/or flooding when water levels and volumes are significantly increased.

Thus, there remains a need for a sediment control product, for example, a silt retention fencing material and/or silt retention system, that features enhanced durability, strength, and the ability to accommodate increased water levels and volumes without being prone to collapse, while also effectively promoting sedimentation, thereby reducing maintenance and improving overall performance of such fencing material and/or silt retention system.

SUMMARY

Briefly described, the present invention generally is directed to a silt retention sheet or silt screen material for use as a vertical interceptor of moving sediment and storm water, which provides varying rates of waterflows therethrough to compensate for increasing overflow storm water conditions, and is provided with reinforcements and enhanced strength along the horizontal and/or width-wise directions thereof. The resultant silt retention sheet material is thus designed to withstand increases in hydrostatic pressure and build-up of silt, dirt and other debris, and to enable varying release of water volumes/flows therethrough as needed to accommodate high water conditions, such as during flooding, without bursting, tearing, collapse or undue bulging of the silt retention sheet that would result in undesirable release of large volumes of silt and debris with such high water flows.

The silt retention sheet includes a body or web that generally will be formed of a woven filtering or geotextile material, such as a spunbond polypropylene, polyester, or similar flexible polymeric materials. Alternatively, other filtering materials, including non-woven or fibrous mat materials also can be used. The body of the silt retention sheet further is formed with designed varying porosities along its width/height so as to allow varying amounts/volumes of water to pass therethrough depending on water levels rising along the sheet, but substantially prevents silt and debris from passing therethrough. The silt retention sheet further includes one or more reinforcing elements, strips, webs, bands, and/or belts that can be integrally formed within the body of the sheet, and/or otherwise integrated into the body of the sheet at spaced intervals along or across the width of the body. Fasteners can be inserted or applied onto or through the water-permeable web of filter material at selected locations along the reinforcing strips to attach the silt retention sheet to stakes or support members.

The reinforcing elements prevent ripping and tearing of the filter material at the points where the fasteners are inserted through or attached to the filter material for supporting the engagement and hold of the fasteners to the filter material against heavy water flows or the accumulation of sediment and debris against the web. The reinforcing elements further provide enhanced horizontal strength and resistance to tearing to the body of the silt retention sheet to guard against rupture and collapse thereof as silt and debris collects thereagainst. Examples of reinforcing materials can include formation of areas or bands of thicker or denser woven sheet material, woven strips of reinforcing materials such as strands of fiberglass, wires, cables, mesh materials and/or other rugged polymeric natural and/or metallic materials woven into or otherwise integrated into the body of the silt retention sheet. The reinforcing elements alternatively also can be applied as strands, cords, arrays, strips, patches, lattice work, or lengths of material attached along the web or body of the silt retention sheet material by stitching, adhesion, felting, impregnation, heat fusion, weaving, or similar means.

According to one aspect of the invention, the body of silt retention sheet material is formed from a woven fabric material and will include a series of flow zones including stages or areas having flow openings of differing apparent opening sizes so as to define varying porosities therealong. For example, the body can have areas of reduced or lower porosities at a lower portion thereof, defining at least one flow control region or zone including a filtering zone against which the bulk of sediment and debris is collected, and a support zone adapted to be covered by soil or other, material. The body can further include an overflow control region including one or more overflow storm water release stages having incrementally greater apparent opening sizes or porosities, increasing in size toward the upper end of the body. The release stages further can be segmented into multiple such regions of differing porosities. For example, the body can include 1-3 or more release stages having increasing flow rates at increasing elevations to release successively greater amounts of run-off water. The reinforcing elements of the body further can comprise linear support bands, strips or similar elements formed as areas of an increased denier per fiber or thickness in the woven material of the body to provide horizontal load support and connection areas for reinforced support of the attachment of fasteners connecting the body to vertical ground supports.

In another embodiment, the silt retention sheet can include a series of water-permeable webs or sheets applied in a layered or stacked fashion, with one or more reinforcing elements disposed therebetween. Alternatively, the water permeable webs can be formed with varying porosities and can be attached together in an overlapping or edge-to-edge contacting arrangement with the reinforcing elements acting to both connect and reinforce the webs, as well as provide for secure attachment points for mounting to posts or other support structures. In such embodiments, it further could be possible to connect a series of webs having desired porosities in series to build a silt fencing arrangement or system of a desired height and/or thickness and with defined, varied porosities provided to each of the connected webs or sections. The webs may be formed of woven and/or nonwoven materials and constructed to allow water to pass therethrough while helping to prevent the passage of silt and/or debris therethrough. The reinforcing element(s) also can include a plurality of reinforcing strands or strips that form a band, or can include a lattice or webbing material. A series of reinforcing bands further can be formed and applied in a manner so as to define a reinforcing structure or array extending along selected portions of the web.

These and other aspects of the present invention are described in greater detail below and shown in the accompanying drawings that are briefly described as follows.

Figure 1:
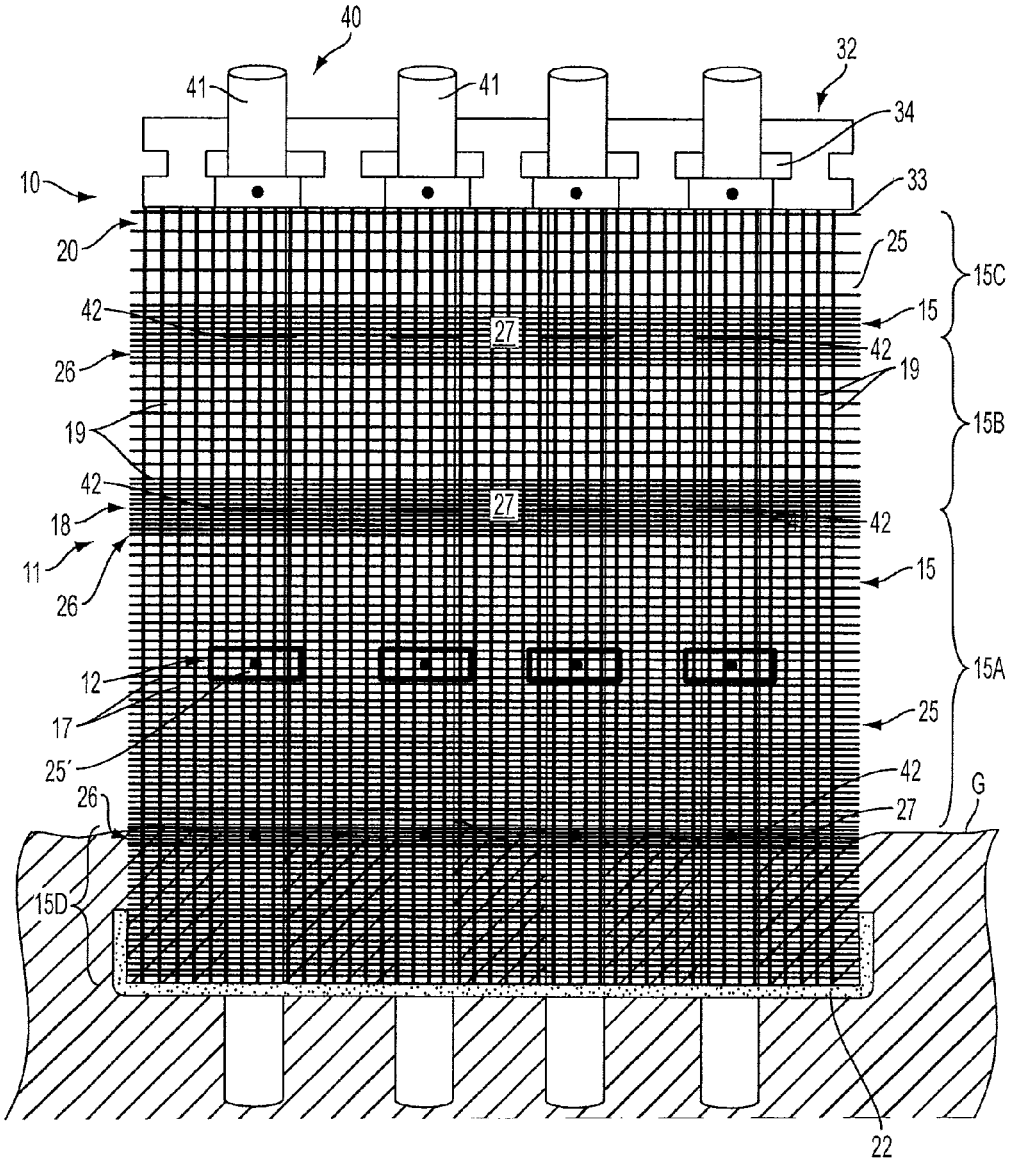
FIG. 1 is a side elevational view of a portion of a silt retention sheet encompassing principles of the present invention.

Various features, advantages and aspects of the present invention may be set forth or apparent from consideration of the following detailed description, when taken in conjunction with the accompanying drawings. Moreover, it will be understood that the accompanying drawings, which are included to provide a further understanding of the present disclosure, are incorporated in and constitute a part of this specification, illustrate various aspects, advantages and benefits of the present disclosure, and together with the detailed description, serve to explain the principles of the present disclosure. In addition, those skilled in the art will understand that, according to common practice, various features of the drawings discussed below are not necessarily drawn to scale, and that dimensions of various features and elements of the drawings may be expanded or reduced to more clearly illustrate the embodiments of the present disclosure.

DETAILED DESCRIPTION

The present invention is directed generally to various erosion control materials and systems and in particular to a reinforced silt retention sheet material and/or system for use as a vertical interceptor of silt, sediment and debris in runoff water flow applications. For example, the silt retention materials may be used to retain silt suspended in storm water flowing from development sites or other erosion-prone areas. Various aspects of present invention may be illustrated further by referring to FIGS. 1-6B, which illustrate various example embodiments thereof. For purposes of simplicity, like numerals may be used to describe like features. It will be understood that where a plurality of similar features are depicted, not all of such features necessarily may be labeled on each figure. While various examples are shown and described in detail herein, it also will be understood that any reinforcing material may be used with any silt retention material described herein or contemplated hereby.

In one aspect, as generally shown in FIGS. 1-6B, the erosion control product or system formed according to the principles of the present invention generally comprises a reinforced silt retention sheet material 10/100/200 including one or more webs or sheets of a substantially water-permeable material including one or more reinforcing elements 25 (FIGS. 1-3) that can be integrally formed therewith or attached thereto. The reinforcing elements 25 are located along the sheets, in positions so as to serve as points of attachment for fasteners that are used to fasten the reinforced silt retention sheets to vertical support members 40 to anchor the sheets in position to filter silt and debris from water passing through the sheet in soil erosion control applications. The reinforcing elements 25 help to reduce the incidence of tearing, pulling, and separation of the water-permeable web material at or around the points of attachment for the fasteners, and further provide horizontal loading support, in addition to the vertical load support provided by the support members, to the web material under conditions of increasing hydrostatic pressure.

As used herein, the term "water-permeable" generally refers to the ability of an element or article to allow water to pass or flow therethrough. The flow rate of water through a "water-permeable" structure as used in the present invention generally will be sufficient for soil erosion control applications in which storm water runoff must be filtered and allowed to pass through the structure without substantial pooling or flooding around the silt retention sheet(s) when installed. For example, flow rates of at least 50-70 gal/min/ft$^2$ or greater (as measured according to ASTM-D-491) can be used. However, it also will be understood that whether a particular material is sufficiently water-permeable will depend on the particular application for which the material is used, the composition of soil in the geographic location where the material is used, the particle size of the each component in the soil, and numerous other factors understood to those of skill in the art. Thus, while certain examples are provided herein, it will be understood that the performance criteria for a given application may vary, and that some materials may be suitable for some applications and not suitable for others.

Figure 4:
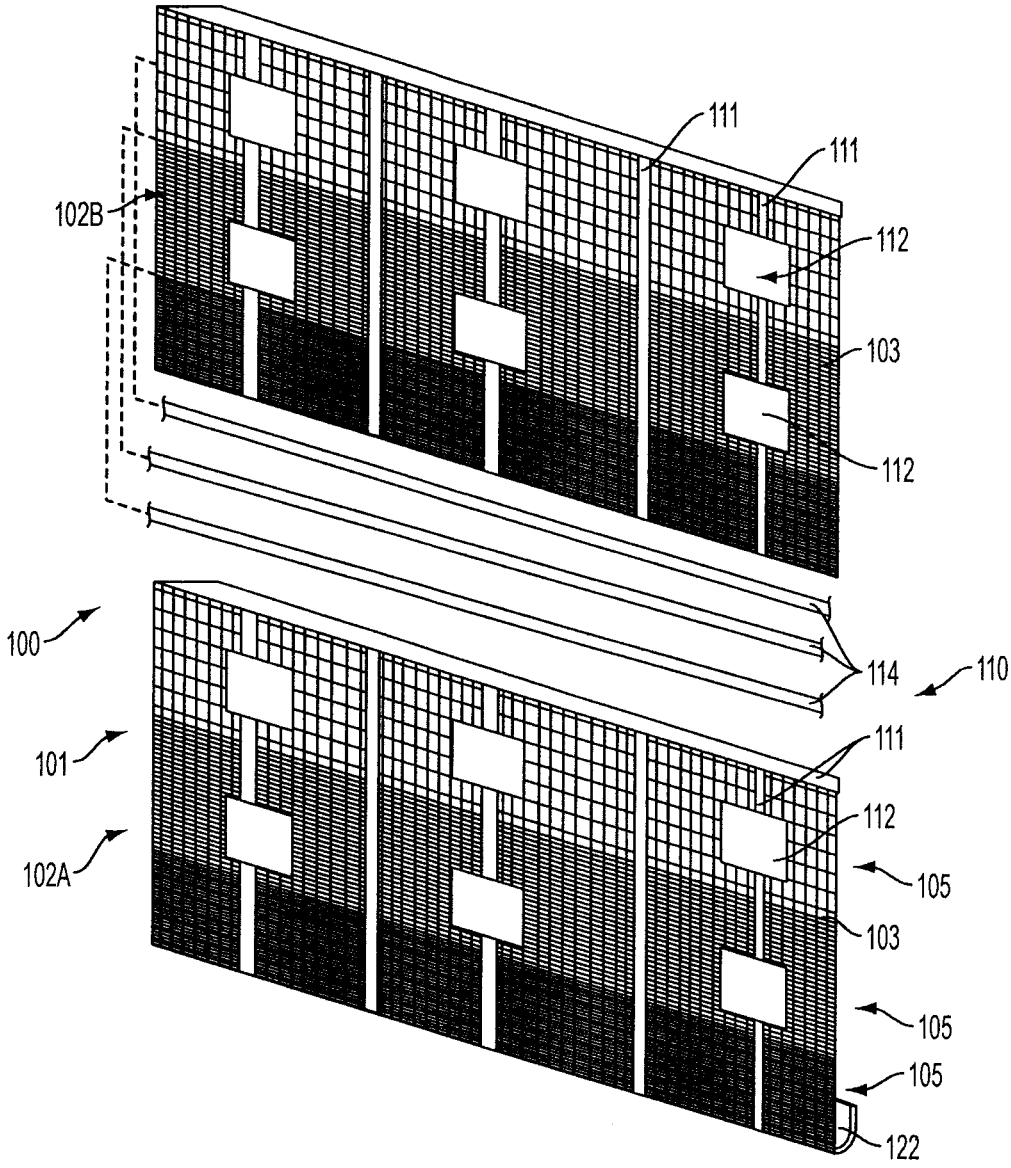
FIG. 4 is a side elevational view of a portion of still another embodiment of a silt retention sheet encompassing principles of the present invention to supports.
Figure 5:
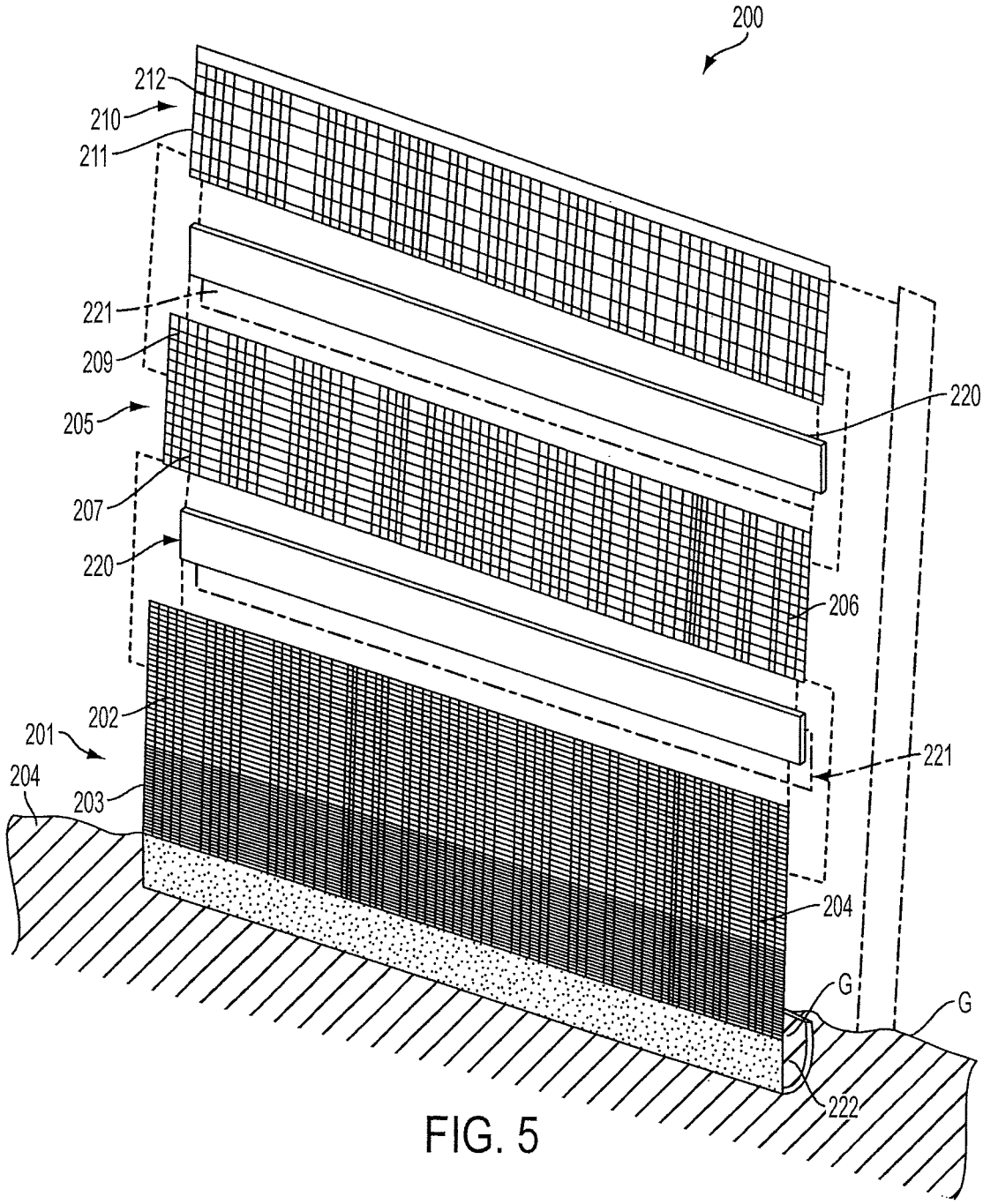
FIG. 5 is a side elevational view of a portion of still another embodiment of a silt retention sheet encompassing principles of the present invention to supports.
Figure 6A:
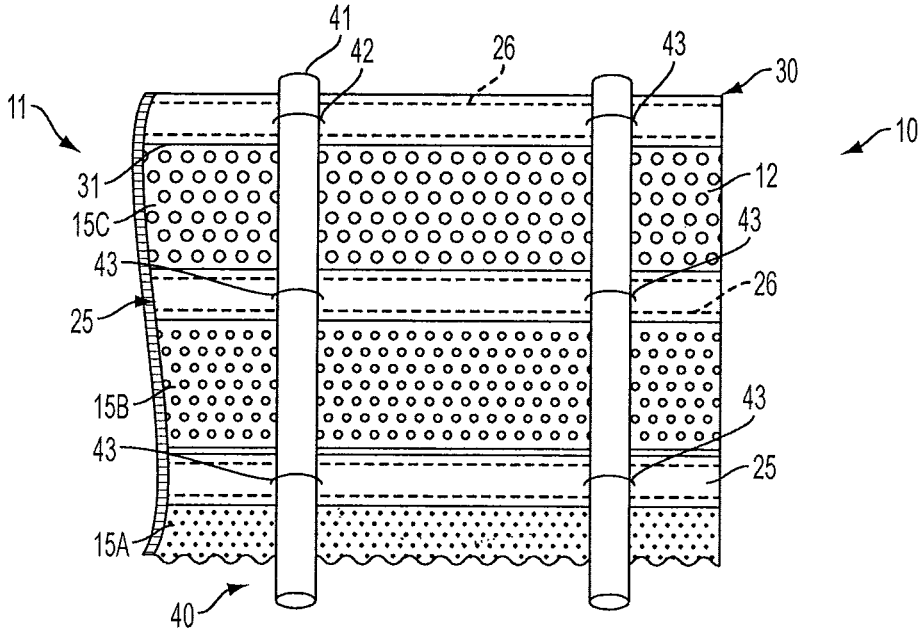
FIGS. 6A-6B are side elevational views illustrating embodiments of the mounting of silt retention sheet encompassing principles of the present invention.
Figure 6B:
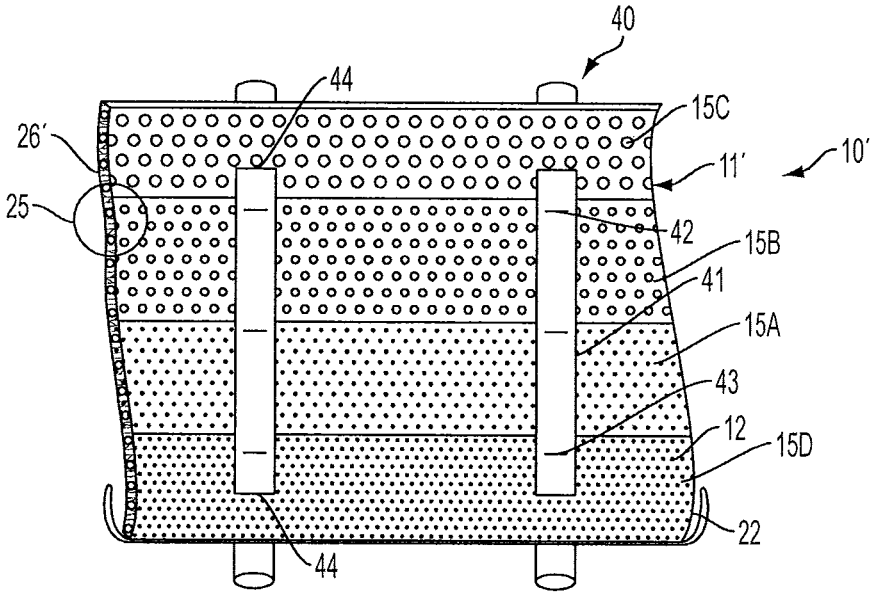

In a first embodiment of the invention as illustrated in FIG. 1, the reinforced silt retention sheet 10 generally includes a blanket or body 11 formed from a water permeable web 12 comprising a geotextile fabric or other, similar water-permeable filter material. A series of reinforcement elements or belts 25 can be integrated within or attached or applied to the body of the silt retention sheet at spaced locations. In this and other aspects of the present invention, the water-permeable web 12 can be formed from any suitable natural or synthetic material. For example, in one embodiment, the water permeable web material 12 illustrated in FIGS. 1, 2, 4 and 5 is generally shown as including a woven material with staged, varying size openings or porosities across its width. FIGS. 3 and 6A-6B alternatively show non-woven materials or webs, such as spun-bonded, knitted or other, similar fabric or sheet filtering materials, with similarly staged varying opening sizes or pores and reinforcement.

Accordingly, various water permeable materials that comply with applicable state and federal environmental regulations and performance requirements for silt retention and storm water control applications, are contemplated for use with the present invention, including woven materials, non-woven materials, extruded, needle-punched or other sheet materials (also referred to as "webs" or "fabrics"), or any combination thereof formed from natural materials, synthetic materials, or any combination thereof. The silt retention material used in accordance with any of the various aspects of the present invention may be formed from one or more polymers or polymeric materials. As used herein the term "polymer" or "polymeric material" includes, but is not limited to, homopolymers, copolymers, such as for example, block, graft, random, and alternating copolymers, terpolymers, etc. and blends and modifications thereof. One example of a fabric that may be suitable for use with the present invention is a reinforced silt retention sheet material such as shown and described in U.S. Reissue Pat. No. RE 42,095, the disclosure of which is incorporated by reference as if fully set forth herein, and can include a needlepunched spunbond polyethylene fabric commercially available from Silt-Saver, Inc. (Conyers, Ga.) under the trade name BELTED SILT RETENION FENCE fabric. Another example of a woven polypropylene fabric that may be suitable for use with the present invention is commercially available from Amoco Fabrics and Fibers Company (Austell, Ga.) under the trade name PROPEX® 1198 geotextile.

The water permeable web material of the reinforced silt retention sheet 10 also may have any suitable basis weight as needed or desired for a particular application, for example, ranging from about 35 to about 275 grams per square meter (gsm), although greater or lesser weights also can be used depending on the particular erosion control application/environment in which the sheet 10 is to be used. The reinforced silt retention fabric sheet 10 further will have any suitable thickness as needed or desired for a particular application, and generally may be from about 0.1 to about 7 millimeters (mm), although greater or lesser thickness also can be used depending on the particular erosion control application/environment in which the sheet 10 is to be used, and an ultraviolet stability in compliance with applicable state and/or federal regulations (e.g., an ultraviolet stability of 80% of minimum tensile strength after 300 hours of weathering per ASTM D-4355). Additionally, the reinforced silt retention fabric sheet can be formed from a series of layered or stacked plies, attached or bonded together such as by stitching, thermal bonding, needle-punching, adhesives, or other attachment means, as illustrated in FIGS. 4-5.

In the embodiment illustrated in FIG. 1, the body 11 of the silt retention sheet 10 generally will comprise a woven sheet material having a series of flow control zones 15 arranged selected, at varying elevations. Depending upon the application, the body of the silt retention sheet can include 2-4 or more staged flow control zones 15, each of which generally is designed to provide for different or varying, controlled volumes or amounts of runoff water flowing therethrough. The flow control zones generally are arranged vertically along the height or width of the body of the silt retention sheet. For example, the silt retention sheet can have a width or height of approximately 36 inches, although greater or lesser heights or widths also can be provided, with at least 2-4 flow control zones 15 providing staged releases of different storm water overflow volumes being formed therealong.

In one embodiment, the flow control zones 15 can include a first flow control or filtering zone, indicated at 15A in FIG. 1, which can extend along a lower portion 16 of the body 11 of the silt retention sheet 10, generally from approximately ground level, as indicated at G in FIG. 1, upwardly for a desired height. This filtering zone 15A generally will be of a height sufficient to receive and block the passage of a desired level of silt projected to be received against the silt retention sheet 10 at a selected job site, for example, extending approximately 10-12 inches above the ground, although greater or lesser heights also can be provided. Typically, the first flow control or filtering zone 15A will have a porosity sufficient to enable a flow rate of at least approximately 50 gallons per minute (gal/min), and generally up to approximately 160 gal/min, and will include a series of pores or openings 17 that can have an apparent opening size of approximately 30 AOS or less. Greater or lesser apparent opening sizes of the pores 17 also can be used to provide for increased capture of silt or for higher flow rates as needed, depending upon the environmental conditions of the site at which the silt retention sheet is to be used.

At least one overflow flow control zone or release stage 15B also generally will be provided, extending vertically from a sediment control level 18 defined by the upper end of the filtering zone 15A, as shown in FIG. 1. A second or additional overflow flow control zones or release stages, such as indicated at 15C, also can be provided. The first and second release stages or overflow flow control zones 15B/15C, as illustrated in FIG. 1, generally will include a series of pores 19 that have an increased apparent opening size as compared to the pores 17 of the sediment flow control zone 15A so as to enable increased water flow rates therethrough. The overflow flow control zones 15B/15C further can include pores 19 of varying apparent opening sizes, for example, ranging from 28 AOS to upwards of about 20-15 AOS or greater, so as to define varying levels of porosity, and thus varying flow rates along the width or height of the body 11 of the silt retention sheet 10. For example, the first overflow flow control zone 15B can be provided with pores of an apparent opening size of approximately 28-25 AOS at a lower portion of the body, providing flow rates of about 220-225 gal/min or more closer to the sediment control level 18, with the apparent opening sizes of the pores 19 of overflow flow control zone 15C increasing to 20-15 AOS and potentially larger, so as to provide increased flow rates of up to about 340-350 gal/min or more, toward the top or upper end 20 of the body of the silt retention sheet.

As a result, as the water level behind the silt retention sheet rises during use, such as due to a buildup of sediment and debris behind the silt retention sheet and/or the incidence of increased runoff water flows due to flooding or heavy rains, controlled, incrementally increasing flows of water are enabled to pass through the silt retention sheet in order to help maintain hydrostatic pressures behind the silt retention sheet at acceptable levels and help the silt retention sheet resist bursting or being washed away due to such increased water flow volumes/pressures while silt and other debris is still retained at the filtering zone. The AOS of each of the flow control zones 15A-15C further can be selected/designed to accommodate projected hydrostatic pressures that will be created as the storm water rises to/above the various release stages defined in the body 11 of the silt retention sheet. For example, if the water level is projected to increase by 15-30% at each flow control zone, the AOS of such states correspondingly can be increased/selected to accommodate for such increased volumes.

Figure 2:
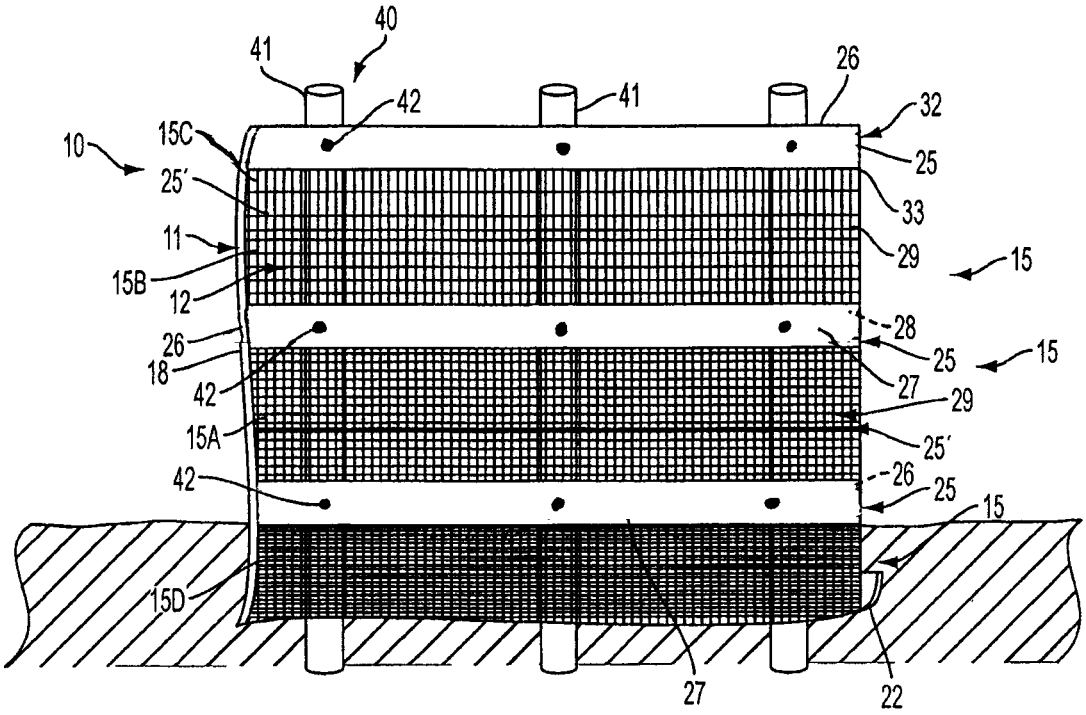
FIG. 2 is a side elevational view of a portion of another embodiment of the silt retention sheet of encompassing the principles of the present invention.
Figure 3:
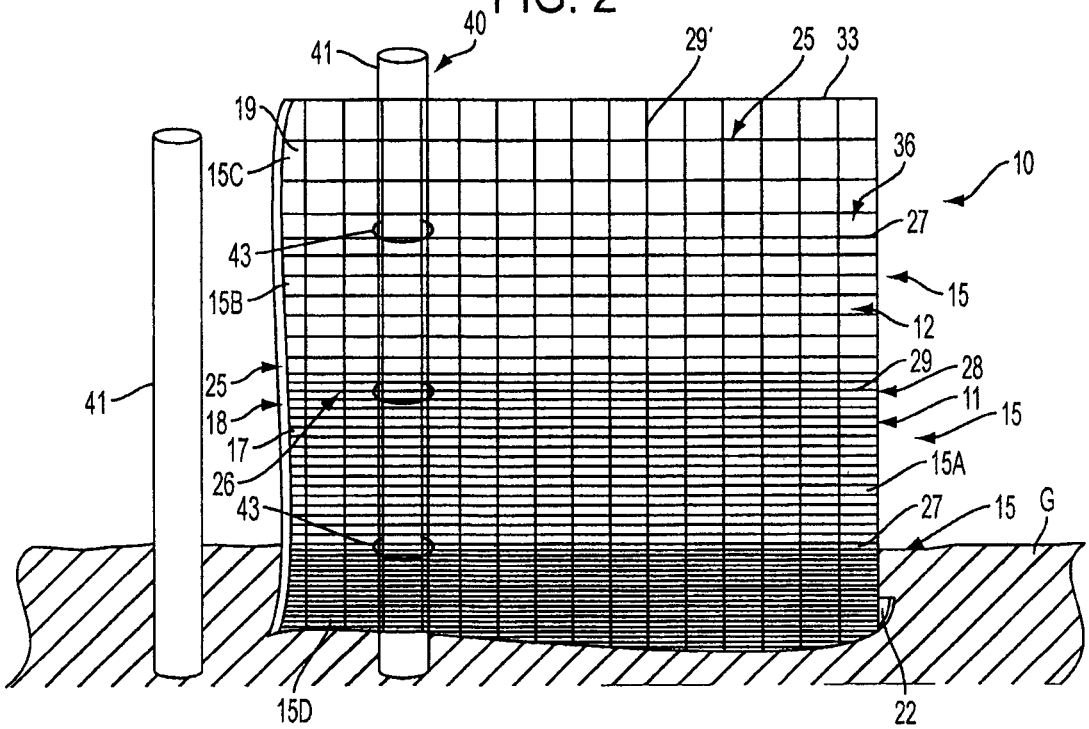
FIG. 3 is a side elevational view of a portion of still a further additional embodiment of a silt retention sheet encompassing principles of the present invention.

In addition, as shown in FIGS. 1-3, another flow control zone 15D, which generally can be formed as a retention or support zone, can be provided along a lower end of the body 11 of the silt retention sheet 10. This retention zone 15D can be formed as a substantially solid sheet or section of the body, or can include pores 21 of a limited apparent opening size. For example, the retention section can be provided with pores of an apparent opening size of generally about 30 AOS or less, in similar fashion to the sediment control flow zone 15A, and/or further can include pores of other apparent opening sizes. The retention section 15D generally can be located below the ground level G, as illustrated in FIGS. 1-3, having ground cover such as dirt, rocks, etc., placed thereover provide support and anchoring for the silt retention sheet, while still enabling passage of water therethrough. In addition, the distal end of the retention section also can include a J-shaped or hooked configuration, which is turned upward to provide a channel or pocket, as shown at 22, or similar area for receiving and engaging the ground cover to provide further anchoring/support of the lower end of the silt retention sheet.

As further illustrated in FIGS. 1-3, reinforcing elements 25 will be provided at spaced locations along the body 11 of the silt retention sheet 10 to provide further strength and support thereto. Such reinforcing elements 25 generally can include various resilient reinforcing materials applied to or formed with the water permeable web material 12 forming the body 11 of the silt retention sheet 10, and can have a width or height of about 0.25"-2.0", although greater or lesser sizes also can be used. For example, the reinforcing elements 25 generally can comprise patches, strips, belts, ribbons, sheets or similar elements formed from the woven material of the body and integrated/formed therewith or can include additional resilient, durable high-strength and non-toxic/environmentally friendly materials, such as a fiberglass reinforced scrim, or belting material.

In one preferred embodiment, such as shown in FIG. 1, the reinforcing elements 25 can be integrally formed with the body 11 by the silt retention sheet 10. For example, the body 11 can be a woven material having a desired denier, e.g., approximately 1 to about 10 denier per fiber (dpf), with the reinforcing elements being formed as areas of an increased denier per fiber. For example, the body 11 can be formed with bands, strips, patches or other areas of an increased thickness of the weave and/or fibers, defining the reinforcing elements 25, and having a higher denier per fiber of approximately 1.5-2 times, or greater, than the remaining sections of body. As a result, the body is provided with integrated reinforcing elements defining linear support areas 26 at selected intervals therealong for strengthening and providing added support for attachment of the body to vertical supports 40. Such linear support areas 26, shown as linearly extending bands 27 in FIG. 1, further provide horizontal load support strength and control to the body as hydrostatic pressure is increased against the body with the rising storm water flow, while the vertical supports provide support/control of the loads in a vertical direction without unduly increasing the thickness or overall weight of the sheet. For example, the present silt retention fence 10 will be provided with a tensile strength of at least about 260-275 lbs. in the warp direction and about 180-220 lbs. in the fill direction, as measured by ASTM D-4632, a bursting strength of at least approximately 175-180 lbs. as measured by ASTM D-3786, and a maximum elongation of about 40% as measured according to ASM D-4632.

The retention elements 25 further can be attached to or integrated within the body of the silt retention sheet by weaving or stitching additional strands, strips or other materials, such as shown at 28 in FIG. 2, bonding, such as through the use of adhesives, thermal bonding, or the like, needle punching or other, similar applications, and/or can be attached to the body with fasteners such as staples or the like. As generally illustrated in FIG. 2, the reinforcing elements also can include cords, cables, wires or other similar materials that are interwoven with or interspersed within the fibers of the water permeable web material 12 during the formation of the silt retention sheet 10, as indicated at 29 in FIG. 2. As a further alternative, other materials such as various mesh geogrid or lattice materials, such as shown at 31 in FIG. 3, also can be used. Such mesh, geogrid or lattice materials further can be used as a base over which a series of fibers can be applied or spun to form the water permeable web material for the body of the reinforced silt retention sheet 10, with the reinforcing elements integrated therein.

The reinforcing elements 25 further can be applied or arranged along the body 11 of the silt retention sheet 10 at spaced locations. By way of example, as shown in FIGS. 1 and 2, the reinforcing elements generally can be formed/located between each of the flow control zones 15 defined along the body 11 of the silt retention sheet 10. The reinforcing elements 25, will thus define transitions between each of the flow control zones, as shown in FIG. 1. The integration of such reinforcing elements, such as by weaving or otherwise forming linear support areas 26, of a greater thickness or higher denier per fiber count in the body further enables creation of substantially seamless transitions from one flow control zone 15 to the next without unduly affecting the flexibility and ease of use of the silt retention sheet, and without substantially increasing the costs of manufacturing the silt retention sheet. The reinforcing elements and/or the flow control zones also can be provided with high visibility colors to delineate flow release/control stages and the silt retention fence formed thereby.

For example, for a silt retention sheet 10 having a height or width of about 36"-40", the upper portion of the body remaining above ground typically can extend approximately 24" with the retention section extending 8-12" below ground and having a pocket 22 of about 4"-6". With the construction shown in FIGS. 1-2, the filtering section 15A can extend approximately 10"-12", with transition between the retention zone 15D and the filtering section 15A of the body having a width, e.g., 0.2.5"-1.0." The transitions between the filtering section 15A and the first and second release stages 15B/15C can likewise include reinforcing elements defined as linear support areas 26, which can be approximately 0.5"-1.0" in width, though greater or lesser widths also can be used, and can be of a high visibility color, such as a bright green (as can be the release stages), and with each of the release stages having a width of approximately 5"-5½". Thus, the reinforcing elements can assist in the controlled transition from smaller to greater AOS between the flow control zones without interfering or creating a blockage to the flow through the silt retention sheet while still providing enhanced horizontal load support to the silt retention sheet.

In addition, it also will be understood by those skilled in the art that the spacing of the reinforcing elements can be varied, i.e., the reinforcing elements can be interspersed at substantially equally spaced locations extending across the width or height of the body of the silt retention material or can be provided with a closer spacing along the body 11 where areas of expected heavier pressures or force applied against the body of the silt retention sheet. Still further, as shown in FIGS. 1 and 2, the reinforcing elements 25 can be formed with various thicknesses and/or widths depending on projected use of the silt retention sheet, and can be formed with a series of pores to prevent undue blockage of water flows through the silt retention sheet. In one such arrangement, thicker, expanded or larger reinforcing elements 25 can be applied at or adjacent the areas where the flow control zones 15A, 15B, 15C and retention zone 15D meet, and thinner or smaller reinforcing elements 25' (as shown in FIGS. 1-2) can thereafter be placed therebetween these larger reinforcing elements as needed, depending upon the application in which the silt retention sheet is to be used. For example, in areas of expected heavier flooding or high silt, dirt or mud flows, such as in areas where landslides or mudslides may be prevalent, such additional reinforcing elements can be added to provide further support and strength to the body of the reinforced silt retention sheet.

As shown in FIGS. 1 and 2, the exemplary reinforced silt retention sheet 10 also can include a reinforcement border 32 attached to the upper edge 33 of the body 11 of the silt retention sheet 10. This reinforcement border and can be formed from a similar material to that of the reinforcing elements 25, or other durable material, including more rigid materials and further helps to strengthen the body 11 of the silt retention sheet 10 and provides an additional area of increased grip/strength for engagement of fasteners for connection of the upper end of the body 11 of the silt retention sheet 10 to ground supports 40. Alternatively, as shown in FIG. 1, the reinforcement border 32 further can be formed with a series of openings 34 that facilitate the location and mounting of the silt retention sheet on the ground supports 40.

FIGS. 1-3 show the reinforced silt retention sheet 10 fastened to ground supports 40, such as stakes 41, by fasteners 42. The stakes 41 can be wooden or metal stakes or rails, but also can be formed from of any other resilient, durable material capable of supporting the web. In this and other aspects of the invention, the fasteners 42 may include staples, pins, nails, rings, clips, or any other suitable fastener for securing the web to the stakes, depending on the type of stakes used. Such stakes or supports can be wood, metal, plastic, or other suitable material, as needed or desired for a particular application. Likewise, any suitable fastener may be used, for example, a staple, pin, clip, hook, hook and loop, snap, band, screw, nail, or any other implement capable of penetrating the fabric and securing it to the stake. For example, as indicated in FIGS. 1-2, the fasteners 42 generally are inserted through the reinforcement elements and the reinforcement border to fasten and retain the silt retention sheet 10 in place against the stakes 41. In this manner, the silt retention sheet 10 may be securely positioned at desired locations for filtering runoff water flows passing therethrough while preventing the passage of silt or debris therethrough.

The reinforcement elements 25 help support the web on the stakes by providing enhanced strength at the points of engagement of the fasteners with the web to resist tearing of the web as silt and dirt build up thereagainst. Alternatively, as shown in FIG. 6A, the silt retention sheet 10 can be attached to the supports 40 by rings or clips 43 fitted about and engaging the supports and penetrating the reinforcement elements 25 from the back of the silt retention sheet. Still further, in the embodiment shown in FIG. 6B, the silt retention sheet 10' is provided with reinforcement elements 25, such as wires, ropes, etc. . . . , integrated within the body 11' thereof so as to define linear supports 26' spaced along the width of the body, with the supports 40, such as stakes 41, shown as being received through slots or other openings 44 and can be further secured to the body by fasteners 42, here shown as staples or clips 43. Such a mounting can provide enhanced support for the body as silt builds up thereagainst.

It will be understood that the various components may be assembled in various other orders, as desired. Also, it will be understood that the fastener may be inserted through the stake or through the sheet, provided that the sheet is securely attached. If desired, the silt retention system may be pre-assembled, such that the stakes are pre-attached to the silt retention fabric using the fasteners. In such an instance, the system may be rolled up, folded, wound onto a support roll, or the like, for easy transportation and assembly. The stakes then would be inserted into the soil as desired.

FIG. 3 shows an alternative embodiment of a reinforced silt retention sheet 10 in which the reinforcement elements generally is in the form of a mesh, lattice or geo-grid structure 36 or applied across the body of the silt retention sheet 10. The mesh or geo-grid reinforcement element structure 31 may be attached to the body of the silt retention sheet as discussed above with regard to attachment of the reinforcement elements 25 thereto, such as by stitching, bonding, etc. As also discussed above, the water-permeable web 12 can be woven, spun, or otherwise formed about the reinforcing element structure 31 so that the reinforcing element structure is substantially integrated therein. Additionally, the reinforcement elements 31 further may be distributed along the silt retention sheet 10 in any appropriate or desired number or pattern to provide multiple spaced areas of reinforcement and/or attachment, such as illustrated in FIG. 3. The body 11 of the silt retention sheet generally is attached via fasteners, such as clips 43 applied through and/or encircling the reinforcement elements and engaging the supports 40 to attach the web to supports and prevent or resist tearing or pulling of the web away from the supports as water passes therethrough.

FIG. 4 illustrates still another alternative embodiment of a silt retention sheet material 100 according to the principles of the present invention. In this embodiment, the body 101 of the silt retention sheet 100 generally is formed from multiple plies 102A/102B of a water permeable fabric or other, similar material 103. While two plies 102A/102B are illustrated in FIG. 4, it will be understood that multiple plies or layers also can be used, and further that each of the plies or layers 102A and 102B further can themselves be formed from multiple plies or sheets attached or connected in series to form a stacked silt retention sheet material or system 100.

The body of each of the plies 102A and 102B forming the body 101 of the silt retention sheet 100 generally will be provided with a series of flow control zones 105 along the width or height thereof, including a filtering zone 105A, overflow release stages 105B-C and a retention stage or zone 105D having a J-shaped portion or pocket 122 at the end thereof, and as discussed above. A series of lateral reinforcing elements 110 generally can be arranged, formed or integrated in the body of each ply at spaced locations along and/or across the plies forming the body of the silt retention sheet, defining linear supports for the body. In addition, in the embodiment shown in FIG. 4, a series of vertical bands or other reinforcing elements 111 can be provided in spaced series. As an alternative, or in addition to such lateral and vertical reinforcing elements, a further series of horizontally oriented reinforcing elements 112 also can be provided positioned in spaced series across one or more of the plies 102A and 102B to provide reinforced attachment areas for receipt of fasteners therethrough to attach the sheet body to vertical supports. Such reinforcing elements 112 can be of a reduced size and can comprise a variety of different reinforcing materials and can include strips, bonds, belts, ribbons, cords, wires, ropes, etc.

In addition, as shown in FIG. 4, the horizontally oriented reinforcing elements 112 can include a series of patches, bands or strips, which do not necessarily have to extend continuously along the length of the body of the silt retention sheet, and it further will be understood by those skilled in the art that such reinforcement patches or strips 112 also can be provided along only one of the plies as needed to provide further attachment points for attaching the silt retention sheet to ground supports. These reinforcing elements 112 can act as fastener supports, which fastener supports may be dimensioned to have any desired width, for example, from about 0.125 to about 0.75 inches. In use, the fastener support areas defined/provided by the reinforcing elements 112 can help minimize tearing of the fabric at or proximate the attachment points along the stake, thereby reducing the rate of failure of the silt retention fence. Furthermore, depending on the particular application, use of a fastener support also may improve sedimentation by providing a more stable fence that is capable of retaining more solids, even during heavy flow.

As further illustrated in FIG. 4, in this embodiment, the lateral reinforcing elements will comprise a series of integrated reinforcing bands or strips 114 that provide to provide additional lateral/horizontal loading strength and resistance to tearing of the silt retention sheet 100. Such reinforcing bands or belts 114 can include reinforcing materials such as discussed above, and generally can be placed in spaced series along the width or height of the body 101 of the silt retention sheet, interspersed between the plies 102A and 102B thereof. The plies thereafter can be affixed together such as by stitching, needle punching, bonding, such as through the use of adhesives or thermal bonding, or other processes so as to form a laminate or composite filtering structure. The resultant filtering structure thus can be constructed as needed with more or fewer reinforcing elements included therewith to form a filtering structure designed to accommodate anticipated high runoff water flow and/or silt concentrations. One of ordinary skill in the art additionally will understand that various combinations of the vertical and horizontal reinforcement elements 111 and 112 and integrated lateral reinforcing bands 114 can be used as needed or desired. For example, the vertical and horizontal reinforcement elements 111 and 112 can be eliminated and only the reinforcing bands 114 utilized, or any combination thereof. The composite filtering structure further can be formed on-site, with the plies or layers being stacked and with reinforcing elements or bands being applied therebetween as needed to enable further variations or customization of the composite filtering structure as needed.

FIG. 5 illustrates still another alternative embodiment of a silt retention fencing or sheet material 200 that can be formed according to the principles of the present invention. In this embodiment, the silt retention sheet 200 generally can be formed as a modular or expandable silt retention fencing or system. As shown in FIG. 5, the silt retention sheet 200 can include a first or lower body section 201, which defines a first, filtering or sediment flow control section 202 and a retention section 203. As shown in FIG. 5, the lower body section will have a series of pores 204 of varying porosities, generally increasing from the retention section 203, i.e., having a pore size of about 30 AOS or less to the top of the sediment flow control section 202, which can have pores of at least 30 AOS, and further can include pores at an upper end thereof of an increased size, i.e., approximately 28-25 AOS. The retention section further can include a hooked retention or ground receiving portion or pocket 222 at its distal end, defining a ground cover receiving pocket for helping to secure the sheet in place.

A second section or region 205 can be provided, defining an intermediate flow control zone that can overlap with or start at and extends upwardly from the sediment flow control zone 202. This intermediate section or area of the silt retention sheet generally will have a series of pores or openings 206 that can vary in terms of their porosity, i.e., increasing in porosity from the bottom edge 207 to the top edge 208 thereof. For example, the pores 206 can be of about 25 AOS and can further increase to about 20 AOS. A third section or portion 210 defining a third or upper overflow control zone 211 can be applied and secured over the upper end 208 of the intermediate section 205. This upper section 210 generally will include pores 212 of a larger apparent opening size to enable still further increased water flow volumes therethrough.

The overlapping edges of each of the sections 201, 205 and 210 of the silt retention sheet 200 of the embodiment shown in FIG. 5 generally can be attached or adhered to one another in a variety of ways. For example, the mating edges of each of the adjacent sections can be bonded or adhesively attached, or can be attached via sewing, needle punching, fasteners, or other mechanisms such as mating hook and loop fasteners extending along the overlapping edges of these sections. In addition, as further indicated in FIG. 5, a series of reinforcing elements 220 can be applied between the sections 201, 205 and 210 to provide for secure attachment of the sections, with these areas of attachment between the sections being further reinforced by the reinforcing elements 220, as well as providing increased horizontal loading strength and support. While the reinforcing elements 220 are shown here as bands, belts or similar materials, it will be understood that various types of reinforcing materials also can be used. The reinforcing elements can be adhesively or releasably attached to the sections of the silt retention sheet 200, overlapping the upper and lower edges of each of the adjacent sections as indicated in FIG. 5, to secure the sections together to form the silt retention sheet, and act as linear supports to the composite silt retention sheet. In addition, as indicated by phantom lines 221, secondary reinforcing elements can be used to help secure the sections of the silt retention sheet 200 together, with the edges or portions of the silt retention sheet being engaged and held therebetween. Adhesive materials, fasteners, stitching, etc., can then be used to secure the mating reinforcing elements 220 and 221 together so as to secure the sections of the silt retention sheet in stacked series.

The attachment of the reinforcing elements connecting the sections of the reinforced silt retention sheet 200 further can be releasable and removable (i.e., via removable fasteners) so as to enable repair and replacement of sections of the silt retention sheet as needed, without having to substantially replace the entire silt retention fence or sheet. In addition, the modular nature of the silt retention sheet 200 of this embodiment further enables additional sections of a water permeable web material having pores with varying apparent opening sizes or porosities to be added to the silt retention sheet 200 as needed or desired. For example, as silt and sediment build up behind the silt retention sheet once installed, effectively raising the ground level therebehind, the intermediate and/or upper, overflow sections of the silt retention sheet can be replaced, for example, by adding additional sections of a lower or smaller porosity, and/or additional overflow sections can be added on top of the existing overflow sections to reconfigure the silt retention sheet as needed.

The reinforced silt retention fabric may be designed to have various properties, as needed or desired for a particular application. Thus, as it will be understood, any fabric filtering material may be used, including but not limited to, those described herein or contemplated hereby. In one exemplary system according to this aspect, the system includes an integrally reinforced woven silt retention fabric, where the reinforcing elements are embedded with the fibers and/or integrally formed within the body by increasing the denier per fiber or thickness of the weave at selected areas to provide a unitary, flexible filtering structure with enhanced strength for connection of fasteners and resistance to horizontal loading, without having substantially bonding or fusing the scrim reinforcing element to or with the fibers. In another exemplary system according to this aspect, the system includes a scrim-reinforced nonwoven silt retention fabric, where the reinforcing material is embedded integrated into the body and is secured further by mechanical entrapment adhesive and/or thermal bonding.

It further will be understood by those of skill in the art that depending on the particular application and the particular jurisdiction in which the silt retention material is used, various minimum physical property and performance requirements may apply. As also noted, the release stages, and the transitions therebetween can be of a high visibility color (with each stage being the same or a different color) to provide a visual delineation of the over flow release and filtering stages and to increase visibility of the silt retention fence for workers.

While the present invention is described herein in detail in relation to specific aspects, it is to be understood that this detailed description is only illustrative and exemplary of the present invention and is made merely for purposes of providing a full and enabling disclosure of the present invention. It will be recognized by those skilled in the art, that various elements discussed with reference to the various embodiments may be interchanged to create entirely new embodiments coming within the scope of the present invention. It is intended that all matter contained in the above description or shown in the accompanying drawings shall be interpreted as illustrative only and not limiting. Changes in detail or structure may be made without departing from the spirit of the invention as defined in the appended claims. The detailed description set forth herein is not intended nor is to be construed to limit the present invention or otherwise to exclude any such other embodiments, adaptations, variations, modifications, and equivalent arrangements of the present invention.

Accordingly, it will be readily understood by those persons skilled in the art that, in view of the above detailed description of the invention, the present invention is susceptible of broad utility and application. Many adaptations of the present invention other than those herein described, as well as many variations, modifications, and equivalent arrangements will be apparent from or reasonably suggested by the present invention and the above detailed description thereof, without departing from the substance or scope of the present invention.

The invention claimed is:

1. A drainage control material for filtering silt and debris from water flows, comprising:

a flexible, water permeable sheet material having a series of stages defined at selected differing elevations therealong, including:

a filtering stage for filtering silt and debris;

a first release stage having a first apparent opening size; and a second release stage at a different elevation from the first release stage and having at least a second apparent opening size that is different from the first apparent opening size; and a plurality of reinforcing elements arranged at spaced locations along the sheet material, including at selected intervals so as to define transitions between the filtering, and the first and second release stages, the reinforcing elements providing areas for attachment of fasteners to the sheet material and providing increased horizontal load strength and resistance to tearing of the sheet material;

wherein the reinforcing elements comprise at least two linear bands arranged at transitions between the first and second release stages;

wherein during periods of excessive water flow, as a water level rises against the sheet material, incrementally varying amounts of overflow water can be permitted to flow through the release stages as needed to help relieve hydrostatic pressure against the sheet material while the reinforcing elements strengthen and provide enhanced horizontal load support to the sheet material as the apparent opening size of the sheet material increases from the first release stage to the second release stage, for retaining and blocking silt from passing therethrough and for resisting collapse of the sheet material, while enabling increased water flows therethrough as the water level rises along the water permeable sheet.

2. The drainage control material of claim 1, further comprising a third flow zone adapted to be placed under ground or otherwise covered to provide for anchoring of the sheet material.

3. The draining control material of claim 1, wherein the second release stage comprises at least two different apparent opening sizes.

4. The drainage control material of claim 1, wherein the second release stage is at a higher elevation along the sheet material than the first release stage and the second apparent opening size is larger than the first apparent opening size.

5. The drainage control material of claim 1, wherein the sheet material comprises a woven material, non-woven material, or a perforated sheet.

6. The drainage control material of claim 1, wherein the first apparent size opening is at least 30 AOS, and the second apparent opening size is at least 25 AOS.

7. The drainage control material of claim 1, wherein the water permeable sheet comprises a woven material with the linear bonds integrally formed therein.

8. The drainage control material of claim 1, wherein the reinforcing elements comprise bands of arranged between each of the release stages and each having a high visibility color.

9. A drainage control system for filtering run-off water flows to remove silt and debris therefrom comprising:

a series of vertically extending supports;

a filtering sheet material attached to the supports and including a series of flow control stages having porosities that increase incrementally from a lower portion to an upper portion of the sheet material, and a series of linear supports along the sheet material at selected elevations of transition between the flow control stages to provide horizontal loading support and reinforced areas for attachment of the sheet material to the supports; and wherein the flow control stages comprise a filtering stage having a flow rate of at least about 50 gal/min, a first release stage having a flow rate of greater than about 50 gal/min up to about 200 gal/min, and a second release stage having a flow rate of greater than about 200 gal/min up to about 340 gal/min, and a support stage defining a lower portion of the sheet material, the support stage having a series of pores to enable passage of water flows therethrough and adapted to receive a ground cover thereover for anchoring the sheet material as silt and sediment is collected against the sheet material; and wherein the filtering stage has pores of a smaller apparent opening size than pores formed in the first and second release stages for substantially trapping and preventing an increased amount of silt and sediment from passing therethrough.

10. The drainage control system of claim 9 and wherein the linear supports comprise bands of arranged between each of the release stages and each having a high visibility color.

11. The drainage control system of claim 9, wherein the sheet material comprises a support stage having a height of approximately 8"-16" and adapted to receive a ground covering thereafter; and wherein the filtering stage comprises a height of approximately 10"-12", the first release stage comprises a height of at least about 5" and the second release stage comprises a height of at least about 5".

12. The drainage control system of claim 11, wherein the linear strips are located between the filtering stage and first release stage and the first release stage and the second release stage and comprise a height of approximately ½"-1".

13. The drainage control system of claim 9, wherein the linear supports comprise areas of the sheet material having an increased denier per fiber of approximately 1.5-2 times a denier per fiber of a remainder of the sheet material.

14. A silt fencing for filtering silt and debris from moving water flows, comprising:

a geotextile silt retention sheet material having a body having a first denier per fiber, and a series of flow control zones defined at selected elevations therealong and having incrementally increasing porosities at height elevations of the sheet material to provide a staged release of increasing amounts of water flows as a level of such water flows rises along the height of the sheet material while enabling settlement of silt and debris within such water flows prior to the water flows rising above a highest stage of release of increased water flow; and a series of linear supports positioned at selected locations within the body of the sheet material, the linear supports comprising areas of a second denier per fiber that is greater than the first denier per fiber of the sheet material;

wherein the linear supports provide support for attachment of the sheet material to a series of support posts, and provide increased horizontal load strength and support to the sheet material at areas of transition between each of the flow control zones, sufficient to substantially resist bulging, tearing and/or bursting of the sheet material due to increasing excessive water flows;

wherein during periods of excessive water flow, as a water level rises against the sheet material, incrementally varying amounts of overflow water can be permitted to flow through the release stages as needed to help relieve hydrostatic pressure against the sheet material while the reinforcing elements strengthen and support the sheet material to offset the increasing porosities of the sheet material, without substantially interfering with the water flows through the sheet material, for retaining and blocking silt from passing therethrough and for resisting collapse of the sheet material as the water level rises along the water permeable sheet.

15. The silt fencing of claim 14, wherein the sheet material comprises a support stage having a height of approximately 8"-12" and adapted to receive a ground covering thereover; and wherein the filtering stage comprises a height of approximately 10"-12", the first release stage comprises a height of at least about 5" and the second release stage comprises a height of at least about 5".

16. The silt fencing of claim 14, wherein the linear supports are located between the filtering stage and first release stage and the first release stage and the second stage and comprise a height of approximately ½"-2".

17. The silt fencing of claim 14, wherein the linear supports comprise bands arranged between each of the release stages and each having a high visibility color.

18. The silt fencing of claim 14, wherein the sheet material further comprises a filtering stage having a flow rate of up to about 150 gal/min, a first release stage having a flow rate of up to about 225 gal/min, and a second release stage having a flow rate of up to about 350 gal/min.

19. The silt fencing of claim 14, wherein the second denier per fiber of the linear supports is at least 1.5-2 times the first denier per fiber of the body of the sheet material.

20. A drainage control material for filtering silt and debris from water flows, comprising:

a flexible, water permeable sheet material having a series of flow control stages defined at selected differing elevations therealong, comprising:

a retention zone adapted to be placed under ground or otherwise covered so as to provide for anchoring of the sheet material, and having a first apparent opening size;

a filtering stage above the retention zone for filtering silt and debris, the filtering state having a second apparent opening size approximately equal to or less than the first apparent opening size of the retention zone;

a first release stage at a higher elevation than the filtering stage and having a third apparent opening size greater than the first apparent opening size;

a second release stage at a higher elevation than the first release stage and having at least an apparent opening size that is at least equal to or greater than the third apparent opening size of the first release stage; and a plurality of linearly extending reinforcing elements arranged at transitions between the flow control stages of the sheet material, the reinforcing elements formed from a resilient material having a tensile strength greater than a tensile strength of the water permeable sheet material for providing areas for attachment of fasteners to the sheet material and providing increased load strength and resistance to tearing of the sheet material;

wherein during periods of excessive water flow, as a water level rises against the sheet material, incrementally varying amounts of overflow water can be permitted to flow through the release stages as needed to help relieve hydrostatic pressure against the sheet material while the reinforcing elements strengthen and support the sheet material sufficient to substantially retain and block silt from passing through the sheet and for substantially resisting bursting and collapse of the sheet material as the water level rises and silt and debris collect along the water permeable sheet.

21. The drainage control material of claim 20, wherein the reinforcing elements are integrated into or formed with the water permeable sheet material.

22. The drainage control material of claim 20 and wherein the retention zone further comprises a J-shaped channel received adjacent a lower end of the water permeable sheet.

23. The drainage control material of claim 20, wherein the reinforcing elements comprise colored elements to delineate the transitions between the flow control stages.

24. A silt fencing for filtering silt and debris from moving water flows, comprising:

a geotextile silt retention sheet material comprising a body having a series of flow control zones defined at selected elevations therealong, at least two or more of the flow control zones having different porosities sufficient to provide a staged release of increasing water flows while continuing to enable filtering of silt and debris within such water flows; and a series of linear supports defined at selected locations along the body of the sheet material, the linear supports formed from a resilient material having a tensile strength greater than a tensile strength of the water permeable sheet material to provide areas of support for attachment of the sheet material to a series of support posts and to provide horizontal load support to the sheet material to substantially resist bulging, tearing and/or bursting of the sheet material;

wherein during periods of increasing water flows, as a water level rises against the sheet material, incrementally varying amounts of overflow water are permitted to flow through the release stages to help relieve increasing hydrostatic pressure against the sheet material while the linear supports define areas of an enhanced horizontal load strength that is greater than a horizontal load strength of the body of the sheet material sufficient to support the sheet material against such increasing hydrostatic pressure, enabling the sheet material to continue to substantially retain and block passage of silt therethrough while resisting collapse of the sheet material as the water level rises therealong;

wherein the sheet material comprises a support stage having a height of approximately 8"-12" and adapted to receive a ground covering thereover; and a filtering stage having a height of approximately 8"-12", a first release stage having a height of at least about 5", and a second release stage having a height of at least about 5"; and wherein the linear supports are located between the support stage and filtering stage, between the filtering stage and first release stage, and between the first release stage and the second stage, and comprise a height of approximately ½"-2".

25. The silt fencing of claim 24, wherein the linear supports comprise colored elements to delineate the transitions between the flow control stages.

26. The silt fencing of claim 24, wherein the linear supports are integrated into or formed with the silt retention sheet material.

* * * * *